United States Patent [19]

Johnson et al.

[11] Patent Number: 4,637,671

[45] Date of Patent: Jan. 20, 1987

[54] THEFT-RESISTANT DEVICE FOR FLUORESCENT LAMP

[75] Inventors: George E. Johnson, Bronxville; Walter Newman, Bayside, both of N.Y.

[73] Assignee: Leviton Manufacturing Company, Inc., Little Neck, N.Y.

[21] Appl. No.: 790,661

[22] Filed: Oct. 28, 1985

[51] Int. Cl.[4] ..... H01R 33/08; H01R 33/97; H01R 13/62

[52] U.S. Cl. ..... 339/50 R; 339/54; 339/92 R; 339/92 M

[58] Field of Search ..... 339/50 R, 50 C, 50 S, 339/54, 75 M, 76, 78, 92 R, 92 M

[56] References Cited

U.S. PATENT DOCUMENTS

| | | | |
|---|---|---|---|
| 468,654 | 2/1892 | Gibbs | 339/75 M |
| 3,059,211 | 10/1962 | Thomas et al. | 339/92 M |
| 3,120,419 | 2/1964 | Dworkin | 339/76 X |
| 3,417,364 | 12/1968 | Kunkle et al. | 339/54 |
| 3,725,850 | 4/1973 | Izumi | 339/92 R |
| 3,783,434 | 1/1974 | Ransford | 339/92 M |

FOREIGN PATENT DOCUMENTS

| | | | |
|---|---|---|---|
| 461907 | 7/1928 | Fed. Rep. of Germany | 339/54 |
| 953370 | 11/1956 | Fed. Rep. of Germany | 339/50 R |

*Primary Examiner*—E. Michael Combs
*Attorney, Agent, or Firm*—Paul J. Sutton

[57] ABSTRACT

A removable locking system for a fluorescent U-tube electrically connected to a mounting body connected to a surface. The mounting body has a flange extending over the coupling member of the connecting end of the U-tube at the mounting body. A locking screw member is threaded through a hole in the flange into pressing contact with the top of the coupling member of the U-tube. A self-locking washer is positioned between the head element of the screw and the top surface of the flange. The locking screw can be rotated to lock or free the U-tube from its mounted association with the mounting body.

6 Claims, 4 Drawing Figures

THEFT-RESISTANT DEVICE FOR FLUORESCENT LAMP

BACKGROUND OF THE INVENTION

This application relates to a theft-resistant device for a fluorescent lamp, and in particular for a u-type fluorescent tube.

A U-type fluorescent tube which is mounted to a mounting body by two pairs of male electrical prongs inserted in female receptacles at only one end of the U-tube is much easier to remove from its connection to its mounting body that is a common fluorescent tube mounted at the ends. The U-tube has only to be quickly and easily removed from the mounting by holding the free end of the U-tube and pulling the tube by pulling the entire tube laterally from its connection. This aspect of the U-tube invites an undesirable result, namely, unauthorized removal of U-tubes. To this problem is added the tendency is to use U-tubes in environments that often are for decorative or partly decorative purposes where the public may go in the course of the general location of the U-tubes.

SUMMARY OF THE INVENTION

The present invention provides a device for discouraging easy theft of a U-tube for a fluorescent lamp from its mounted position which overcomes the problems of easy removal of the U-tube as set forth above.

Accordingly, it is an object of this invention to provide a device for a U-tube for a fluorescent lamp which prevents easy removal of the U-tube from its mounted position.

It is another object of this invention to provide a device that clamps the coupling member at the connected end of a U-tube with the mounting body to which the U-tube is electrically mounted so as to prevent easy theft of the U-tube.

It is another object of the present invention to provide a screw that passes through the mounting body that presses against the electrical connecting end of the U-tube so that the U-tube cannot be removed from the mounting body without a tool.

The present invention fulfills the above objects and overcomes the limitations and disadvantages of prior art by providing locking system for a U-tube having opposed connecting and free ends, the connecting end having two pairs of male electrical contacts; a mounting body connected to a support surface, the mounting body being adapted to mount the U-tube at the connecting end and providing two pairs of female electrical contacts, or receptacles, adapted to receive the male contacts and also providing electrical contacts between the female receptacles and a source of electrical power; a locking screw removably connected to the mounting body adapted to secure the connecting end of the U-tube into pressing contact with the mounting body; and a support member connected to the body member adapted to provide support for the U-tube in a direction opposed to the pressing contact exerted by the locking screw, so that the U-tube cannot easily be removed form its mounted relationship with the mounting body. A somewhat resilient coupling member hold the two tube portions of the U-tube together at its connecting end. The mounting body includes a body wall transverse to the orientation of the U-tube and a flange extending from the edge of the body wall lateral to and spaced from the upper side of the coupling member. A threaded hole is formed by the flange with an axis generally perpendicular, or transverse to the upper side of the coupling member. The locking screw in the upper side has external threads adapted to mate with the internal threads of the hole. The locking screw has a contact end in pressing contact with the upper side of the coupling member and an opposed head element that lies on the outer side of the flange. A self-locking washer is positioned between the head element of the locking screw and the outer surface of the flange. The locking screw has an elongated body, or stem, that is of such a length that the head element presses against the top of the self-locking washer when the contact end of the screw is at its maximum position pressed into the flexed surface of the coupling member.

The present invention will be better understood and the objects and important features, other than there specifically set forth above, will become apparent when consideration is given to the following details and description, which when together in conjunction with the annexed drawings, describes, discloses, illustrates, and shows preferred embodiments or modifications of the present invention and what is presently considered and believed to be the best mode of practice in the principle thereof.

BRIEF DESCRIPTION OF THE DRAWINGS

Reference is now made in detail to the drawings wherein similar reference characters denote similar elements throughout the severed views.

Figures 1, 2:
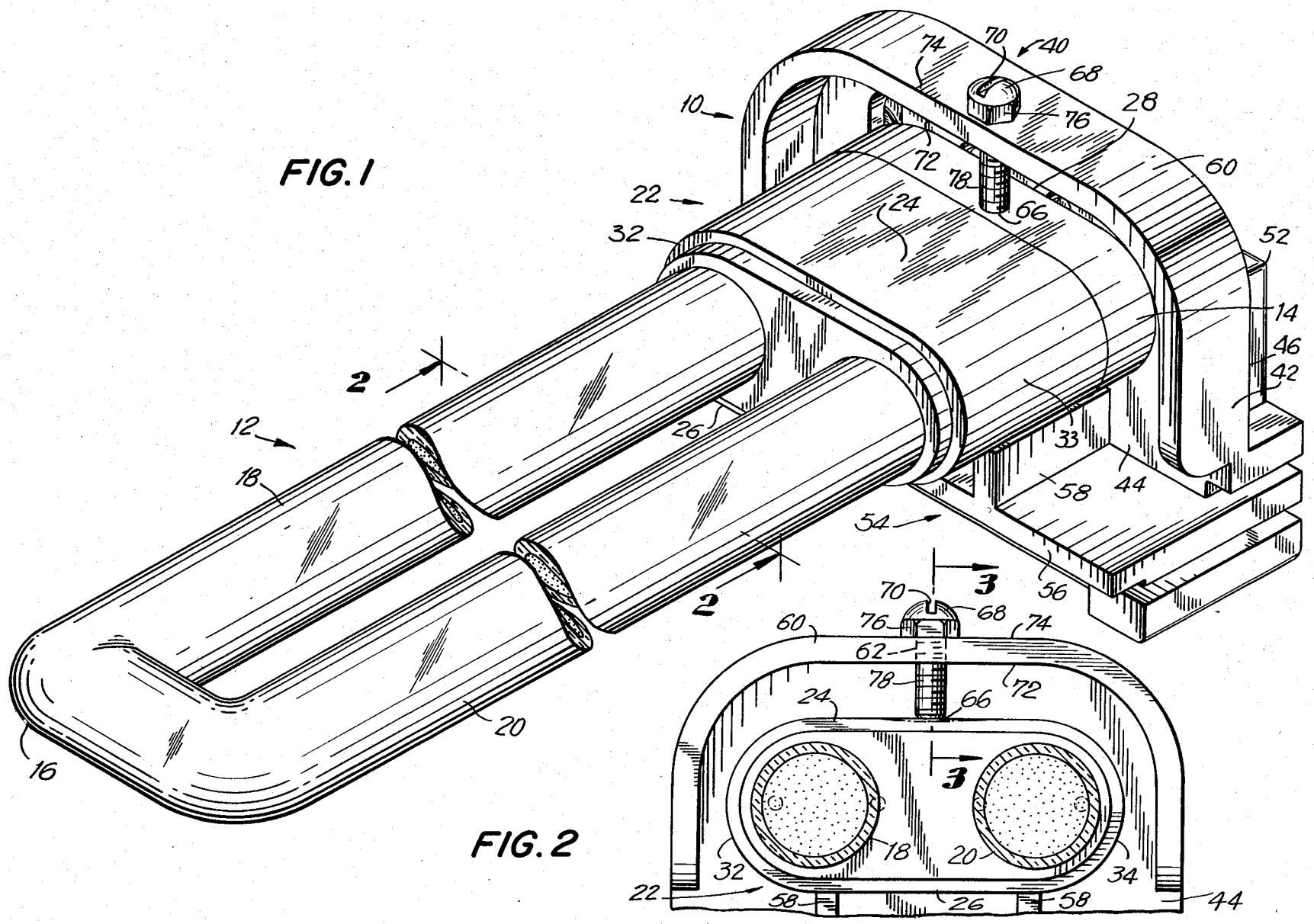
FIG. 1 is a foreshortened perspective view of the locking system.
FIG. 2 is a view taken through plane 2—2 of FIG. 1.
Figures 3, 4:
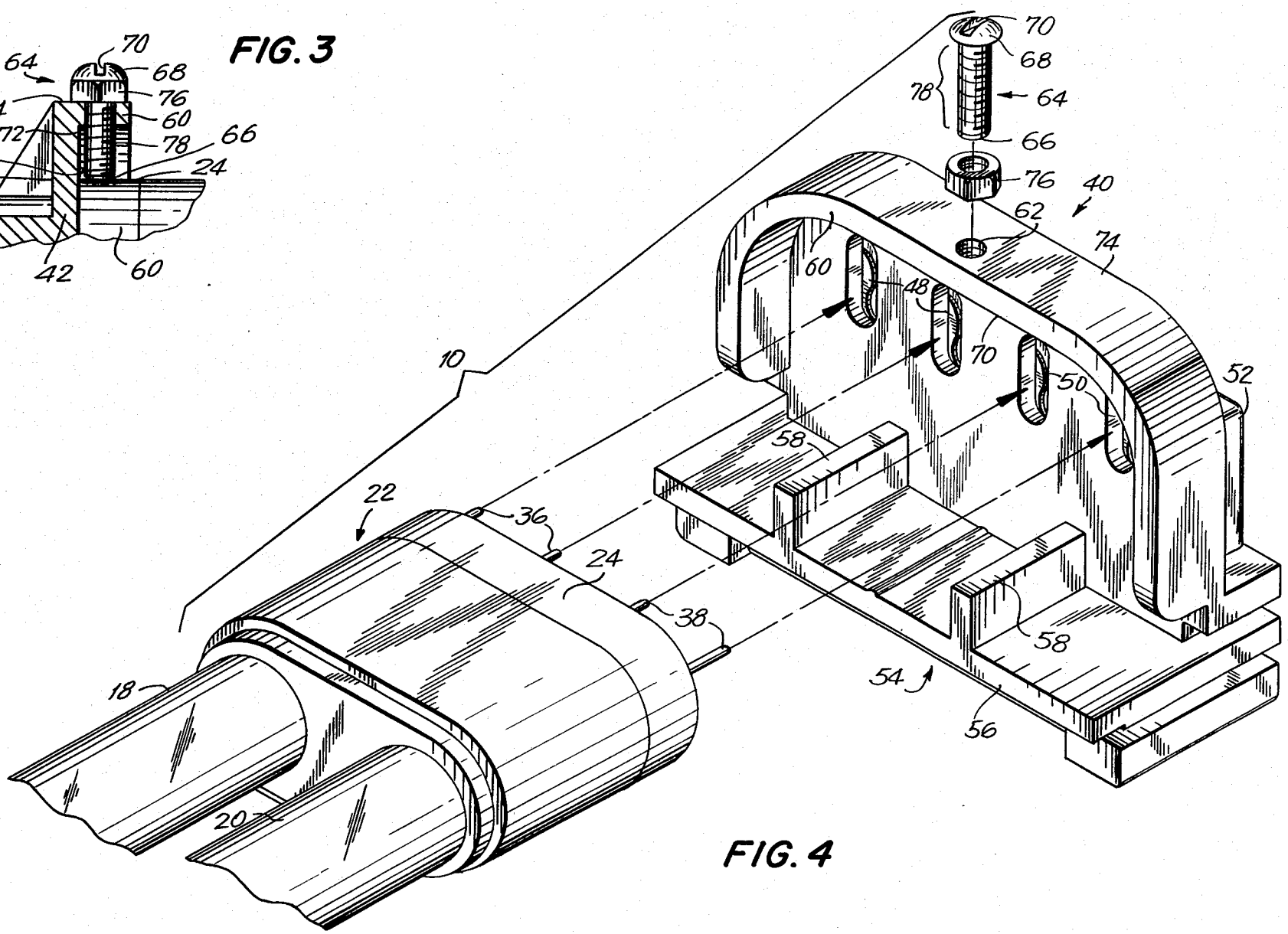
FIG. 3 is a view taken through line 3—3 of FIG. 2.
FIG. 4 is a partial exploded perspective view of the locking system.

A locking system 10 for a U-shaped fluorescent tube 12, hereinafter referred to as U-tube 12, is shown in foreshortened perspective view in FIG. 1. U-tube 12 has a connecting end 14 and an opposed free end 16. U-tube 12 includes two parallel, slightly spare, tube portions 18 and 20 connected at free end 16 in a U-bend. U-tube 12 includes a coupling member 22 at connecting end 14 which is adapted to hold tube portions 20 and 22 in non-movable alignment. Coupling member 22 is made of a generally firm, but somewhat resilient material such as hard rubber or resilient plastic with similar characteristics. Coupling member 22 includes opposed cross-walls 24 and 26. Inner and outer wall intersect with cross-walls 24 and 26. Opposed semi-cylindrical end walls 32 and 34 encircle the outside areas of tube portions 18 and 20 and join cross-wall 24 and 26. Cross-wall 24 is shown as the upper wall and cross-wall 26 as the lower wall in the embodiment shown in the figures. Although U-tube 12 is shown extending in a general horizontal direction in the figures, the U-tube can be positioned in other alignments, such as extending vertically upwardly from connecting end 14. Inner wall 28 grips two pairs of male electrical connecting prongs 36 and 38 which are electrically connected to the ends of tube portions 18 and 20, respectively, as seen in FIG. 4.

Mounting system 10 includes a mounting body 40 which is adapted to hold U-tube 12. Mounting body 40 includes a body wall 42 having opposed inner and outer surfaces 44 and 46, respectively, with inner surface 44 being generally transverse to the direction of orientation of U-tube 12 and generally parallel to inner wall 28 of coupling member 22. Body wall 42 forms two pairs of female electrical receptacles 48 and 50 aligned in a row lateral to upper and lower cross-walls 24 and 26 at inner surface 44 adapted to receive male prong pairs 36 and 38, respectively, so as to electrically connect U-tube 12 with an external power source (not shown). Mounting body 40 holds electrical contacts (not shown) known in the art of fluorescent lamps that are connected to the power source. A mounting portion 52 is positioned at outer surface for connection to electrical leads and to a vertical base surface (not shown). U-tube 12 can be mounted vertically besides being mounted horizontally as shown.

Mounting body 40 includes a support member 54 comprising a support wall 56 extending generally perpendicularly, or transversely, from body wall 42 to a position spaced directly from, or below, lower cross-wall 26. Support member 54 also includes a pair of spaced, parallel support member 58 connected to support wall 56 extend through the space between cross-wall 26 and support wall 56 to bearing contact with lower cross-wall 26. The bearing surfaces of support member 58 are in the same plane with lower cross-wall 26.

A flange 60 extends inwardly towards U-tube 12 from and transverse to the upper and side edge portions of body wall 42 and lateral to and spaced from upper cross-wall 24. Flange 60 forms a hole 62 having internal threads and having an axis transverse to upper cross-wall 24. An elongated locking screw member 64 having external threads adapted to mate with the internal threads of hole 62 extends through hole 62 transverse to upper cross-wall 24 of coupling member 22. Screw member 64 has a contact end 66 and a head end having a head element 68. Contact end 66, which is preferably flat and generally parallel with upper cross-wall 24, is in pressing contact with upper cross-wall 24, with the surface of cross-wall 24 being slightly deformed at the point of contact. It is to be noted that the locking effect of the pressure of contact end 66 with cross-wall 24 would also be effective with a stiff, or non-flexible material used for coupling member 22, but of course, the gripping effect of screw member 64 is greater when the material of coupling member 22 is somewhat flexible, as is shown in the figures.

Head element 68 forms a cross-slat 70 adapted to receive the driving end of a screw driver. Head element 68 is longer than hole 62. Flange 60 has opposed internal and external surfaces 72 and 74, respectively, relative to coupling member 22 with head element 68 being in operative association with external surface 74.

A self-locking washer 76 of a type known in that of locking devices is positioned between external surface 74 and head element 63, which is in pressing contact with locking washer 76. Screw member 64 includes the screw stern, or body, 78 having a length measured between head element 68 and contact end 66. Flange 60 has a thickness measured between internal and external surfaces 72 and 74; upper cross-wall 24 is spaced from internal surfaces 72 of flange 60 at a distance; and self-locking washer 76 has a washer thickness. The length of screw body 78 is slightly greater than the sum of flange 60, the distance between cross-wall 24 and internal surface 72, and the thickness of washer 76. It is to be noted that this last relationship exists when coupling member 22 is slightly resilient. Locking screw member 64 has such a length that head element 68 presses against the top of self-locking washer 76 when contact end 66 is at its maximum locking position pressed into the inwardly flexed surface of upper cross-wall 24. Support member 54 provides support for U-tube 12 in a direction opposed to the pressure exerted by the pressing contact of locking screw member 64 so that an opposed resistance to screw member 64 exists and U-tube 12 is removably locked between support member 54 and screw member 64.

U-tube 12 is initially removably locked into removable relationship with mounting body 40 by placing self-locking washer 76 over hole 62 and screwing locking screw member 64 with a screw driver at cross-slot 70 through the threads of washer 76 and of hole 62 until contact end 66 presses against and slightly flexes the surface of coupling member 22 of U-tube 12 at upper cross-wall 24. At this time head element 68 is in its maximum pressing relationship with the top of self-locking washer 76. At this time the locking relationship is complete and the screw driver is removed. Removal of U-tube 12 is accomplished by rotating locking screw member 64 from coupling member 22 sufficiently to remove U-tube 12 from mounting body 12. Upon replacement of a new U-tube 12 with body member 40, locking screw member 64, which is still screw through hole 62, is screwed against upper cross-wall 24 as described above.

The embodiment of this invention particularly disclosed and described herein above is presented merely as an example of the invention. Other embodiments, forms, and modifications of the invention coming within the proper scope and spirits of the claims, will, of course, readily suggest themselves to those skilled in the art.

What is claimed is:

1. A locking system for a U-type tube of a flourescent lamp, comprising, in combination, said U-tube having opposed connecting and free ends, said connecting end having two pairs of male electrical contacts, said U-tube includes two parallel tube portions and a coupling member at said connecting end adapted to hold said two tube portions in non-movable alignment, body means connected to a surface, said body means being for mounting said U-tube at said connecting end and for providing two pairs of female electrical contacts adapted to directly receive said male contacts, said body means also being for providing electrical contacts between said female contacts and a source of electrical power, wherein said mounting body includes a body wall, said U-tube being generally transverse to said body wall, said body wall forming the said two pairs of female electrical receptacles adapted to receive said two pairs of said male members in electrical contact, said coupling members having a first and a second opposed cross-wall, said cross-walls being disposed across said two U-tube portions in planes generally transverse to said body wall, locking means connected to said body means for removably securing said connecting end of said U-tube into pressing contact with said body means;

support means connected to said body means for providing support for said U-tube in a direction opposed to the pressing contact exerted by said locking means; whereby the U-tube cannot easily be removed from its mounted relationship with the body means, said mounting body includes a flange extending from a portion of said body wall, generally perpendicularly from said body wall, towards said coupling member, spaced from the first cross-wall of said coupling member, said flange forming a hole having internal threads and having an axis generally parallel to the body wall and generally transverse to said first cross-wall, and said locking means is an elongated screw member having external threads adapted to mate with said internal threads of said hole, said screw member extending through said hole generally transverse to said first cross-wall, said screw member having opposed contact and head ends, said contact end being in pressing contact with said first cross-wall, said support means comprising a support member extending generally laterally from a portion of said body wall towards said coupling member, spaced from and opposite to said flange, to a position in which a portion of itself is in support contact with said second cross-wall of the coupling member, whereby said support member provides resistance to said screw member.

2. A locking device in accordance with claim 1, wherein said coupling means includes a slightly resilient portion, and said contact end of said screw member bears upon said resilient portion.

3. A locking device according to claim 2, wherein said head end of said screw member includes a head element forming a slot adapted to receive the driving portion of a screw driver, said head element being larger than said hole, said flange having opposed internal and external surfaces relative said coupling member, said head element being disposed in operative association with said external surface.

4. A locking device according to claim 3, wherein said locking means includes a self-locking washer positioned between said head element of said screw member and said external wall of said flange, said head element being in pressing contact with said washer.

5. A locking device according to claim 4, wherein said screw member includes a screw body having a length measured between said head element and said contact end, said flange has a thickness measured between said internal and external surfaces, said one cross-wall is spaced from said internal surface of said rim flange at a distance, and said washer has a washer thickness; and wherein said length of said screw body is slightly greater than the sum of said thickness of said flange, said distance between said one cross-wall and said internal surface of said rim flange, and said washer thickness.

6. A locking device according to claim 5 wherein said portion of said support member in contact with said second cross-wall comprises a pair of spaced, generally parallel support members, generally parallel with said parallel tube portions.

* * * * *